United States Patent [19]

Levine

[11] 4,185,560

[45] Jan. 29, 1980

[54] FORE AND AFT FUZING SYSTEM

[76] Inventor: Mayer Levine, 10658 Cass St., Arlington, Calif. 92503

[21] Appl. No.: 170,286

[22] Filed: Jan. 31, 1962

[51] Int. Cl.[2] ..... F42C 13/04; F42C 13/02

[52] U.S. Cl. ..... 102/214; 102/213

[58] Field of Search ..... 102/70.2, 50, DIG. 44; 250/83.3 I, 83.3 R; 343/5 GC, 5 MD, 7, 13 B

[56] References Cited

U.S. PATENT DOCUMENTS

| | | | |
|---|---|---|---|
| 2,259,982 | 10/1941 | Alexanderson et al. | 102/214 |
| 2,441,030 | 5/1948 | Page | 102/207 |
| 2,892,093 | 6/1959 | Henderson | 102/213 |
| 2,931,300 | 4/1960 | Lord et al. | 102/213 |

*Primary Examiner*—Charles T. Jordan

*Attorney, Agent, or Firm*—Richard S. Sciascia; Joseph M. St. Amand; T. M. Phillips

EXEMPLARY CLAIM

1. In a guided missile fuze system that has optimum kill probability against all sizes of targets, the combination comprising:

(a) a fuzing channel for generating an output pulse in response to a received target signal after a predetermined time delay from the time said target signal is received, (b) a guard channel for generating an output pulse in response to the loss of a target signal detected by said guard channel, (c) and a firing circuit coupled to the outputs of said fuzing channel and said guard channel for firing the fuze in response to a firing pulse received from either of said channels.

7 Claims, 6 Drawing Figures

FORE AND AFT FUZING SYSTEM

The invention herein described may be manufactured and used by or for the Government of the United States of America for governmental purposes without the payment of any royalties thereon or therefor.

The present invention relates to a fore and aft fuzing system and more particularly to a fore and aft fuzing system which effects the detonating of a warhead in the lethal burst position regardless of size of the target.

In known fixed angle microwave fuze systems, the warhead burst position is determined by the following sequence of operations: (a) A delayed time is computed on the basis of closing velocity information, (b) The delayed time begins when the fuze detects any part of the target at a fixed angle from the missile axis, and (c) The warhead is detonated at the end of the delayed time. In the known systems, the delay computed for any particular closing velocity is necessarily a compromise between the delays required for targets of radically different sizes and for widely different directions of missile approach to the target. The shortest delay that will burst the warhead in a lethal position for a large target frequency exceeds the longest delay that will yield a lethal burst against a small target at a comparable closing velocity. The best compromise delay is thus relatively ineffective against one or both classes of targets.

This invention utilizes the loss of signal occurring when the conical beam of the guard channel detection pattern has swept over the target and enters the region of free space. The loss of signal occurring at this instant is used to over-ride the computed delay, and to terminate the delay, detonating the warhead at this instant. In fuzes incorporating this invention the time delay computer could be designed to instrument longer delays than would be appropriate for the compromise used in the old systems, and these longer delays would be more effective against large targets, yet the fuze system would also be effective against small targets by the action of the target signal dropout time delay terminator. Thus the fuze would be effective against targets of all sizes.

Accordingly, an object of the present invention is to provide a fuzing system which will be effective regardless of the size or type of target encountered.

Another object is to provide a fuzing system which will detonate the warhead in the event a target is acquired and then lost prior to a predetermined time delay based on information from time of acquisition and closing velocity between the missile and target.

Other objects and many of the attendant advantages of this invention will become readily appreciated as the same becomes better understood by reference to the following detailed description when considered in connection with the accompanying drawings wherein.

Figure 1:
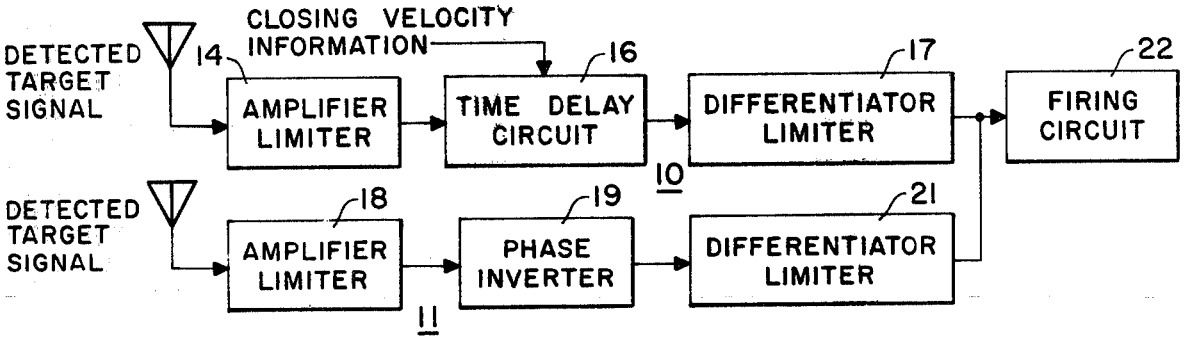
FIG. 1 is a block diagram of a preferred embodiment of the invention.
Figure 2:
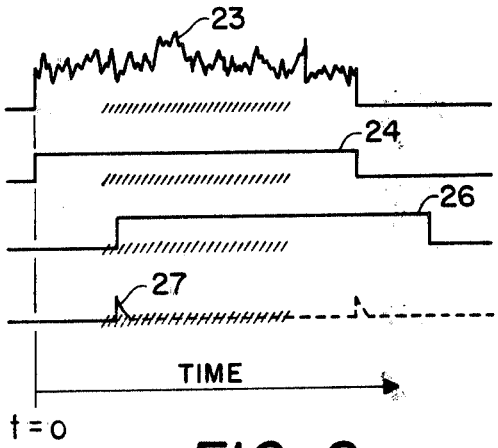
FIGS. 2 and 3 are graphs used in conjunction with the explanation of the invention.
Figure 3:
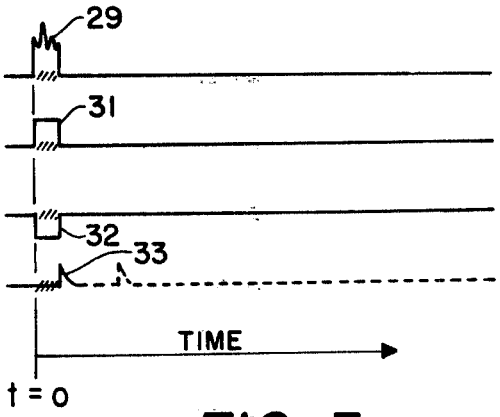
Figure 5:
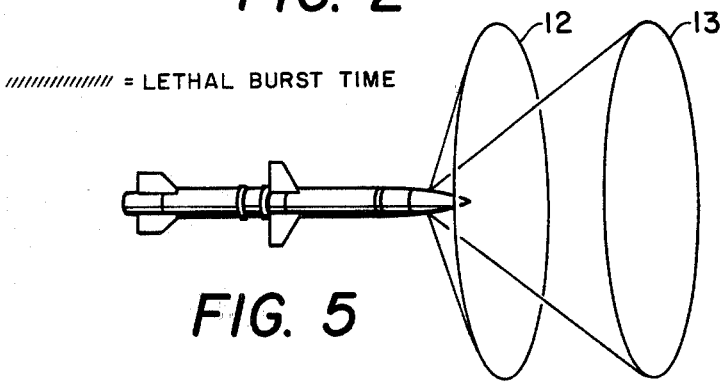
FIG. 5 is a representative showing of the conical patterns utilized in the embodiment of FIG. 1.

Referring now to the drawings, wherein like reference characters designate like or corresponding parts throughout the several views, there is shown in FIG. 1 a simplified block diagram of the parts of the fuze system that pertains to an illustrative embodiment of the invention. In the embodiment shown in FIG. 1 there are two channels 10 and 11 for receiving signals from targets. Conical beam 12 of the fuze detection pattern is associated with channel 10 while conical beam 13 is associated with channel 11 (FIG. 5). Channel 10 comprises an amplifier limiter 14, a time delay circuit 16, and a differentiator limiter 17, while channel 11 comprises an amplifier limiter 18, phase inverter 19 and differentiator limiter 21. The outputs of both channels are fed into a firing circuit 22. Channel 10 is the fuzing channel and assuming the target is of sufficient size a detected target signal is received first in channel 11 and then in channel 10. Channel 10 produces a firing pulse at the end of a predetermined time delay as shown in the graph of FIG. 2. Detected target signal 23 is received and fed through amplifier 14 to produce the output waveform 24, which is fed into time delay circuit 16. Closing velocity information which may be obtained from the guidance and control system of the missile is also fed into time delay circuit 16 for determining the proper delay time. Output waveform 26 from time delay circuit 16 is fed into differentiator limiter 17 to produce firing pulse 27 at the end of the time delay, i.e., at the beginning of waveform 26. Channel 11 produces a firing pulse at the loss of signal as shown in FIG. 3. Waveform 29 may represent a small target or it may represent a large target under certain intercept conditions. The detected signal 29 from a small target is fed into amplifier 18 to produce waveform 31 which is inverted in phase inverter 19 to produce waveform 32. Waveform 32 is differentiated in differentiator limiter 21 to produce firing pulse 33. Therefore, if a large target is detected by conical beam 13 and then detected by conical beam 12 which starts the time delay and the target signal is not lost in channel 11 before the expiration of the time delay in channel 10 then the fuze will be fired at the end of the predetermined time delay by fire pulse 27. However, if the target is first detected by channel 11 and then detected by channel 10 which starts the time delay; but the signal is lost by channel 11 before the expiration of the time delay, then a firing pulse 33 is generated by channel 11 to fire the fuze.

Figure 4:
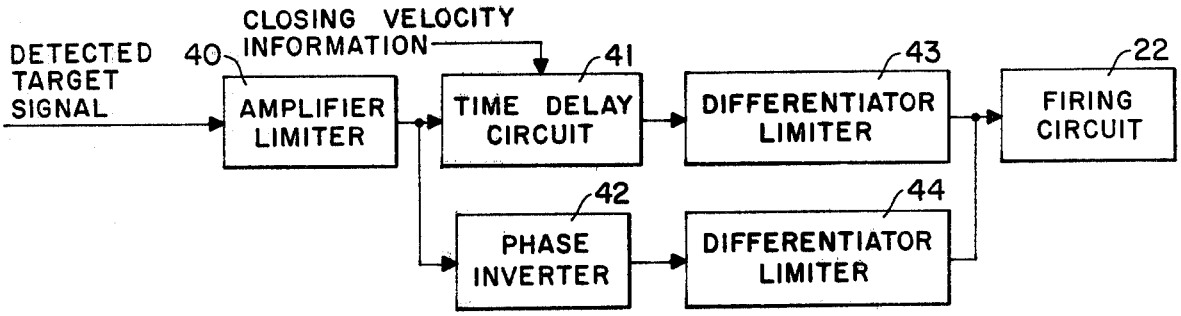
FIG. 4 shows a modification of the embodiment of FIG. 1.

Referring now to FIG. 4 there is shown a modification of the embodiment of FIG. 1 which uses only one conical beam detection pattern. The received signal is fed through amplifier limiter 40 in the same manner as 14 of FIG. 1 to produce waveform 24 or 31 depending on the size of the target. The output from amplifier limiter 40 is simultaneously fed through time delay circuit 41 and phase inverter 42 to produce waveforms 26 and 32 respectively. If the received target signal is of sufficient duration then the output of time delay circuit 41 is fed into differentiator limiter 43 and produces a firing pulse 27 at the end of the time delay. If the received signal is from a small target and is lost, waveform 32 is differentiated in differentiator limiter 44 to produce firing pulse 33.

Figure 6:
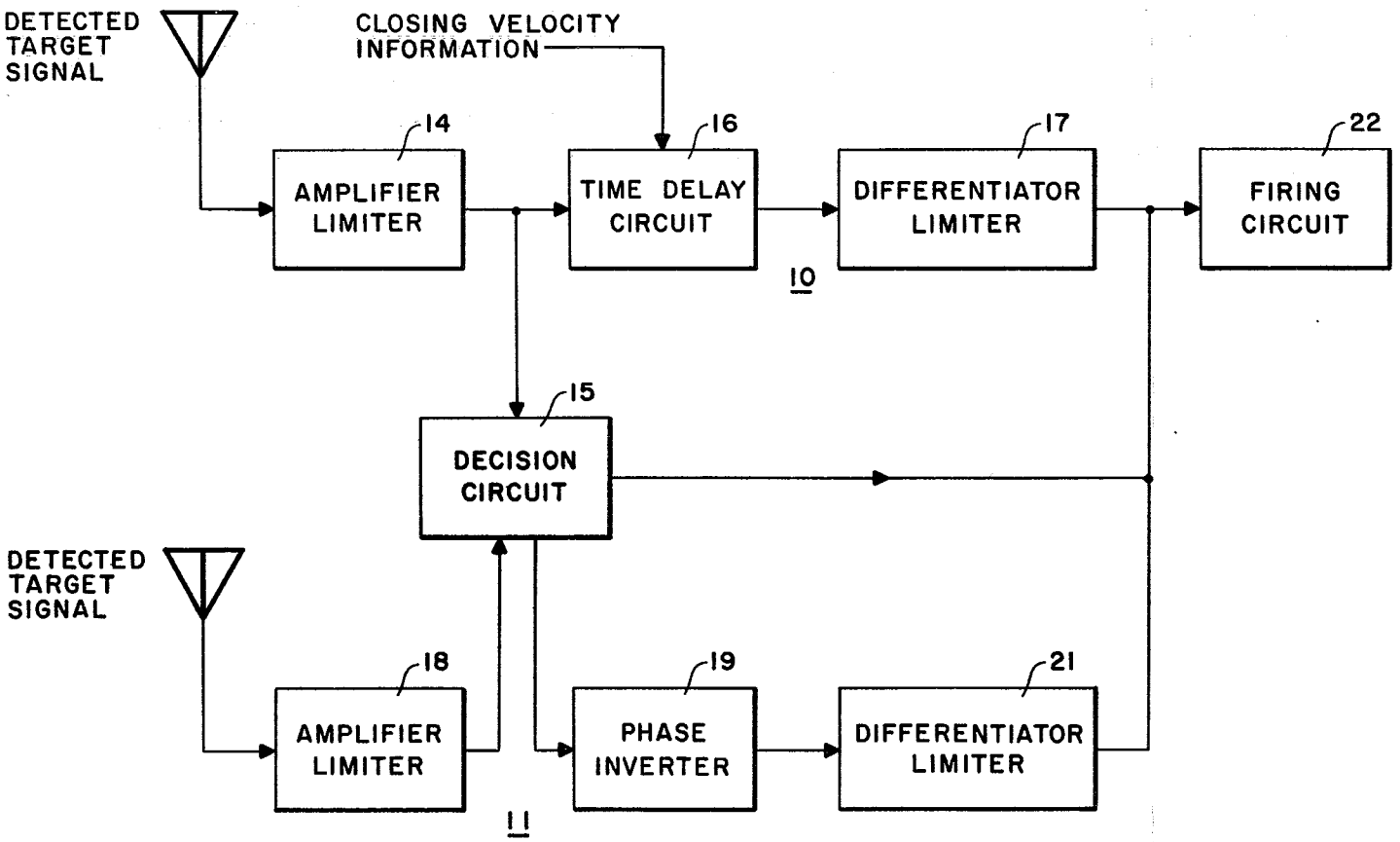
FIG. 6 is a block diagram of a further modification of FIG. 1.

FIG. 1 may be further modified as shown in FIG. 6 by feeding the outputs of amplifier limiters 14 and 18 into a decision circuit 15 which will not allow any signal to pass to phase inverter 19 until a signal from amplifier limiter 14 is detected. If a signal is detected from amplifier limiter 14 and no signal has yet been received from amplifier limiter 18 then a firing pulse will be fed directly to firing circuit 22. Thus, the time delay will be overidden and cause the fuze to fire immediately.

This system is not limited to microwave or fixed angle fuzing, but may be used with fixed angle optical fuzes or variable angle fuzes.

Obviously many modifications and variations of the present invention are possible in the light of the above teachings. It is therefore to be understood that within the scope of the appended claims the invention may be practiced otherwise than as specifically described.

What is claimed is:

1. In a guided missile fuze system that has optimum kill probability against all sizes of targets, the combination comprising:

(a) a fuzing channel for generating an output pulse in response to a received target signal after a predetermined time delay from the time said target signal is received, (b) a guard channel for generating an output pulse in response to the loss of a target signal detected by said guard channel, (c) and a firing circuit coupled to the outputs of said fuzing channel and said guard channel for firing the fuze in response to a firing pulse received from either of said channels.

2. A fuze system as in claim 1 wherein means is provided which prevents any target signal pulse from being fed through said guard channel unless a target signal pulse is first received in said fuzing channel and which will provide a firing pulse directly to said firing circuit when a target signal pulse is present in said fuzing channel and no target signal pulse is present in said guard channel.

3. In a guided missile fuze system that has optimum kill probability against all sizes of targets, the combination comprising:

(a) a fuzing channel for generating an output pulse in response to a received target signal after a predetermined time delay, (b) bypass circuit means coupled to said fuzing channel for generating an output pulse in response to the cessation of said target signal prior to the expiration of said time delay, (c) and a firing circuit coupled to the output of said fuzing channel and to said bypass circuit means for firing the fuze in response to a first received pulse from any one of said fuzing channel and said bypass circuit means.

4. In a guided missile fuze system that has optimum kill probability against all sizes of targets, the combination comprising:

(a) a first amplifier limiter for receiving a signal reflected from a target and for producing an output waveform proportional to the average amplitude of said received signal, (b) time delay circuit means coupled to said first amplifier limiter for delaying the output of said first amplifier limiter by a predetermined time interval, (c) first differentiator limiter means coupled to said time delay circuit means for generating an output pulse at the end of said predetermined time interval, (d) firing circuit means coupled to said first differentiator limiter means and responsive to said output pulse for generating a firing pulse for said fuze system, (e) a second amplifier limiter for receiving a signal reflected from said target a finite time interval before a signal is received at said first amplifier limiter and for producing an output waveform proportional to the average amplitude of the signal received by said second amplifier limiter, (f) a phase inverter coupled to said second amplifier limiter for inverting the output waveform of said second amplifier limiter, (g) second differentiator limiter circuit means coupled to said phase inverter and being responsive to the cessation of the output waveform of said phase inverter to generate an output pulse, (h) and circuit means coupling the output of said second differentiator to said firing circuit.

5. A fuze system as in claim 4 wherein a decision circuit means is provided which prevents any signal pulse from being fed to said phase inverter until an output pulse from said first amplifier limiter is received by said decision circuit means and which will feed a firing pulse directly to said firing circuit when an output pulse from said first amplifier limiter is received by said decision circuit means and no signal has first been received by said decision circuit means from said second amplifier limiter.

6. In a guided missile fuze system that has optimum kill probability against all sizes of targets, the combination comprising:

(a) an amplifier limiter for receiving a signal reflected from a target and for producing an output waveform proportional to the average amplitude of said received signal, (b) time delay circuit means coupled to said amplifier limiter for delaying the output of said amplifier limiter by a predetermined time interval, (c) first differentiator limiter means coupled to said time delay circuit means for generating an output pulse at the end of said predetermined time interval, (d) a phase inverter coupled to the output of said amplifier limiter for inverting the output waveform of said amplifier limiter, (e) second differentiator limiter circuit means coupled to said phase inverter and being responsive to the cessation of the output signal of said phase inverter to generate an output pulse, (f) and firing circuit means coupled to the outputs of said first and second differentiator limiter means for generating a firing pulse for said fuze system in response to the first generated output pulse.

7. In a guided missile fuze system that has optimum kill probability against all sizes of targets, the combination comprising:

(a) a fuzing channel for generating an output pulse in response to a received target signal after a predetermined time delay from the time said target signal is received, (b) a guard channel for generating an output pulse in response to the loss of a received target signal that was detected by either one of said guard and fuzing channels, (c) and a firing circuit coupled to the outputs of said fuzing channel and said guard channel for firing the fuze in response as a firing pulse received from either of said channels.

* * * * *